US005275512A

United States Patent [19]

Wright

[11] Patent Number: 5,275,512

[45] Date of Patent: Jan. 4, 1994

[54] MINE ROOF EXPANSION ANCHOR AND BAIL MEMBER THEREFOR

[75] Inventor: Raymond L. Wright, Syracuse, N.Y.

[73] Assignee: The Eastern Company, Naugatuck, Conn.

[21] Appl. No.: 913,167

[22] Filed: Jul. 14, 1992

[51] Int. Cl.[5] ..... E21D 20/00

[52] U.S. Cl. ..... 405/259.6; 405/259.4; 405/259.1

[58] Field of Search ..... 405/259.1, 259.3, 259.4, 405/259.5, 259.6; 411/47, 32, 15, 64, 67

[56] References Cited

U.S. PATENT DOCUMENTS

| | | | |
|---|---|---|---|
| 4,453,845 | 6/1984 | Donan, Jr. | 405/259.3 |
| 4,626,139 | 12/1986 | Blackwell | 411/67 X |
| 4,744,699 | 5/1988 | Price et al. | 405/259.5 |
| 4,859,118 | 8/1989 | Schaeffer | 405/259.3 |
| 5,018,908 | 5/1991 | Laphon | 411/64 X |
| 5,082,399 | 1/1992 | Frease et al. | 405/259.5 X |
| 5,087,160 | 2/1992 | Pezzutto | 405/259.1 X |

*Primary Examiner*—Dennis L. Taylor
*Assistant Examiner*—J. Russell McBee
*Attorney, Agent, or Firm*—Charles S. McGuire

[57] ABSTRACT

A bail member having a medial portion of substantially conical shape for retaining shell and tapered plug portions of a mechanical expansion anchor in mutually assembled relation prior to installation. The medial portion is positioned over the large end of the plug and tapers inwardly in a direction away from the plug to provide a lead-in for insertion of the anchor, carried on the end of a mine roof bolt, into the open end of a blind drill hole. The bolt and medial portion may include an axial bore and a plurality of openings, respectively, for passage of a hardenable grout pumped through the bore to provide an anchoring system of enhance strength and durability.

30 Claims, 2 Drawing Sheets

MINE ROOF EXPANSION ANCHOR AND BAIL MEMBER THEREFOR

BACKGROUND OF THE INVENTION

The present invention relates to bail-type mine roof expansion anchors and, more particularly, to bail members of unique structure for holding the shell and camming plug of an expansion anchor in mutually assembled relation prior to installation.

For many years, one of the most widely used means of supporting and reinforcing rock structures such as mine roofs has been a mechanical expansion anchor having a hollow shell and tapered nut or camming plug held together by a bail. The shell structure is radially expanded into gripping contact with the wall of a drill hole in the rock by axial movement of the tapered camming plug into the shell. The plug is moved by rotation of a bolt in threaded engagement with a central bore in the plug. The bolt is rotated by a power wrench engaged with the bolt head outside the drill hole, and the bolt is tensioned by the wrench after the anchor is set.

Mining machinery in common use today may include a magazine holding a number of bolts with expansion anchors mounted thereon, and a movable boom structure carrying a power drill and wrench in addition to the magazine. A drill hole of appropriate diameter and depth is formed in the rock structure by the power drill. When the drill bit is extracted, the boom is moved laterally to position the bolter head, holding a bolt and anchor assembly taken from the magazine, under the entrance to the hole. The bolter head, which includes the wrench engaging the head of the bolt, is then advanced to insert the end of the bolt carrying the expansion anchor, into the drill hole. When the bolt is fully inserted, placing a bearing plate carried by the bolt head in engagement with the surface of the rock formation around the drill hole entrance, the bolt is rotated to set the anchor and tension the bolt.

In some applications, it is desirable to place a flowable grout or slurry in the drill hole, surrounding at least the upper end of the bolt and mechanical anchor. The grout subsequently hardens to enhance the strength and durability of the anchoring system. The grouting mix may be inserted after the mechanical anchor is installed by being pumped through a central bore extending through the bolt. In such cases, it is of course necessary that the bail or other anchor structure permit flow of the grout to the intended locations.

In the installation of mechanical anchors carried on the ends of bolts it is sometimes difficult to align the bolt with the drill hole opening and get the anchor inserted into the hole. This is particularly true when using the aforementioned, boom-type bolting machines. It is not uncommon for the drill opening, having a diameter of, e.g., 1½"–2", to be 16 feet or more above the surface upon which the machine is supported. Thus, proper positioning of the boom may be extremely difficult.

It is a principal object of the present invention to provide a novel mine roof expansion anchor with means facilitating insertion of a bolt carrying the anchor on its threaded end into a blind drill hole in a mine roof, or the like.

Another object is to provide a bail member of novel and improved design which assists in the insertion of a mine roof expansion anchor assembly which includes the bail into the open end of a drill hole.

A further object is to provide a bail member, and expansion anchor assembly including such a bail member, which may be advantageously used in a mine roof anchoring system employing a bolt having a bore through which a hardenable grout or slurry is pumped into the drill hole.

Other objects will in part be obvious and will in part appear hereinafter.

SUMMARY OF THE INVENTION

The bail member of the present invention includes the usual pair of legs extending integrally from a medial portion for connection at or near their terminal ends to the shell of the expansion anchor. The medial portion of the bail is of generally conical configuration, tapering inwardly from a peripheral edge, from which the legs extend, to a crown. In the preferred embodiment, the peripheral edge is scalloped, the medial portion tapers at an angle of about 55°, and the crown is essentially flat and has a central, through opening. An additional plurality of through openings are provided in the body of the medial portion, symmetrically arranged about the crown.

The anchor assembly wherein the bail member is incorporated includes a hollow, radially expansible shell and a tapered camming plug, each of which may be of any suitable, conventional design. The elements are assembled in the usual manner with the smaller diameter end of the plug in the upper end of the shell, the medial portion of the bail extending over the larger diameter end of the plug and the bail legs extending substantially parallel to one another and fixedly attached to the shell structure.

The distal, threaded end of a mine roof bolt passing through the shell and the internally threaded bore of the plug extends into the inner, concave side of the tapered, medial portion of the bail, providing reinforcement therefor. The outer, convex side of the bail medial portion thus provides a convenient lead-in as the assembly is inserted in a drill hole in a mine roof, or the like. This is especially helpful when employing power bolting machinery to insert the anchor and bolt at relatively large distances. The openings in the bail medial portion and the scalloped peripheral edge thereof provide passages for a grout or slurry pumped through an axial bore in the roof bolt.

The foregoing and other features of the present invention will be more readily understood and fully appreciated from the following detailed description, taken in conjunction with the accompanying drawings wherein:

DETAILED DESCRIPTION

Figure 1:
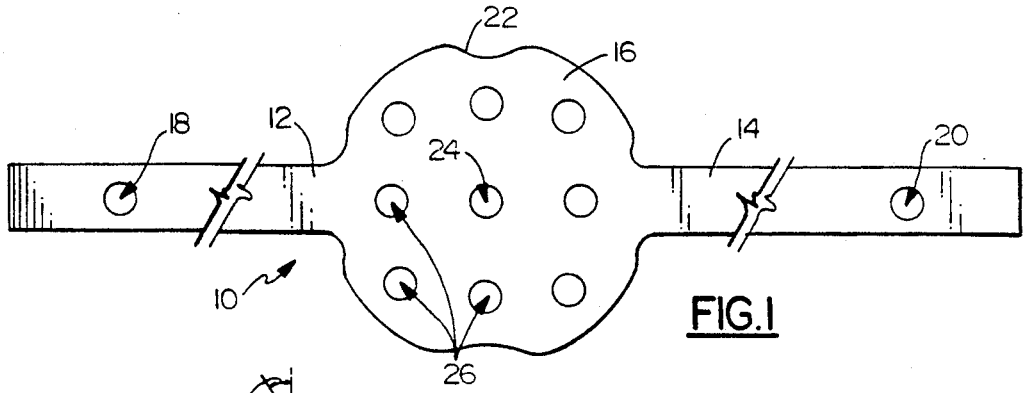
FIG. 1 is a plan view of a sheet metal blank used in forming the bail member of the invention.

Referring now to the drawings, in FIG. 1 is seen a sheet metal blank, denoted generally by reference numeral 10, from which the preferred embodiment of the bail member of the invention is fabricated. Blank 10 is cut or stamped from a suitable strip of sheet metal, e.g., cold rolled steel, ¼ hard, Rb 60–75 or hot rolled steel, pickled and oiled, ¼ hard, R1 60–75, having a thickness of 0.057". Blank 10 includes a pair of elongated legs 12 and 14 extending integrally from opposite sides of medial portion 16. Through openings 18 and 20 are formed in legs 12 and 14, respectively, and medial portion 16 includes peripheral edge 22 which may be scalloped, as shown, or circular. Through opening 24 is formed at the geometric center of medial portion 16, symmetrically surrounded by a plurality of additional through openings 26.

Figure 2:
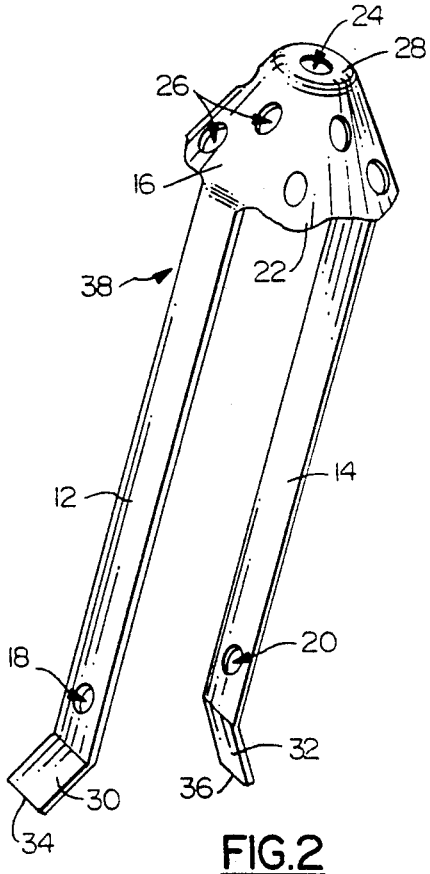
FIG. 2 is a perspective view of the finished bail member.

After blank 10 has been cut in the manner indicated, medial portion 16 is formed over a suitable die to substantially conical or dome-shaped configuration, as seen in FIG. 2. After the forming operation, openings 26, which are circular in blank 10, assume a somewhat elliptical configuration. The central portion of the dome, surrounding opening 24, forms an essentially flat crown, denoted by reference numeral 28. Legs 12 and 14 extend substantially parallel to one another, and may include portions 30 and 32, extending outwardly and downwardly to terminal ends 34 and 36, respectively. The finished bail is denoted generally by reference numeral 38. Although not critical, the angle of taper of medial portion 16 is preferably about 55° to its central axis, as indicated in FIG. 3.

Figure 3:
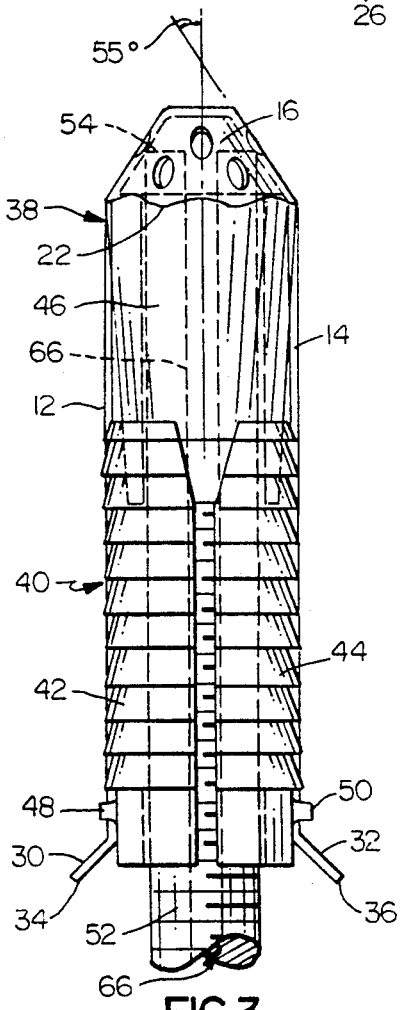
FIG. 3 is a front elevational view of an expansion anchor assembly incorporating the bail member of FIG. 2, showing also the distal end of mine roof bolt upon which the anchor is carried.

A typical expansion anchor assembly 40 incorporating bail 38 is shown in FIG. 3. Although any of a number of conventional shell and plug designs may be employed in the anchor assembly for purposes of the present invention, those shown in FIG. 3 correspond generally to the anchor assembly of U.S. Pat. No. 5,094,577. The radially expansible shell portion is formed of two identical, physically separate shell halves 42 and 44 which are maintained in assembled relation with one another and with tapered camming plug 46 by bail 38. Pins 48 and 50 extend integrally from shell halves 42 and 44, respectively, through openings 18 and 20 in bail legs 12 and 14, and are peened over to permanently secure the bail legs, at positions near their terminal ends 34 and 36, to the shell halves near their lower (in the orientation of FIG. 3) ends. Thus, as in prior expansion anchor assemblies, the smaller diameter end of plug 46 extends into the open, upper end of the shell structure and the bail medial portion passes over the larger diameter end of the plug, which preferably contacts the medial portion about peripheral edge 22.

Figure 4:
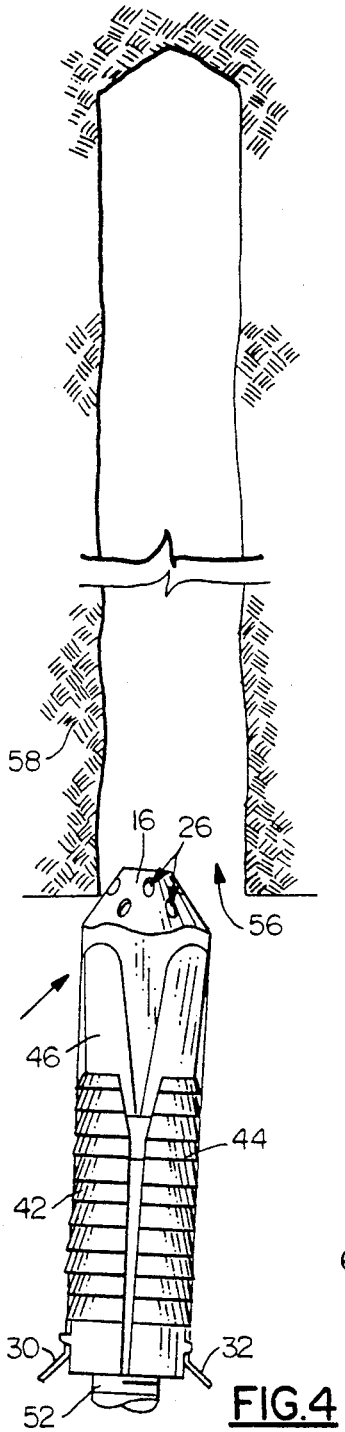
FIGS. 4–6 are a series of elevational views illustrating steps the installation of a mine roof support system employing the bail member of the invention and the anchor wherein it is incorporated.
Figure 5:
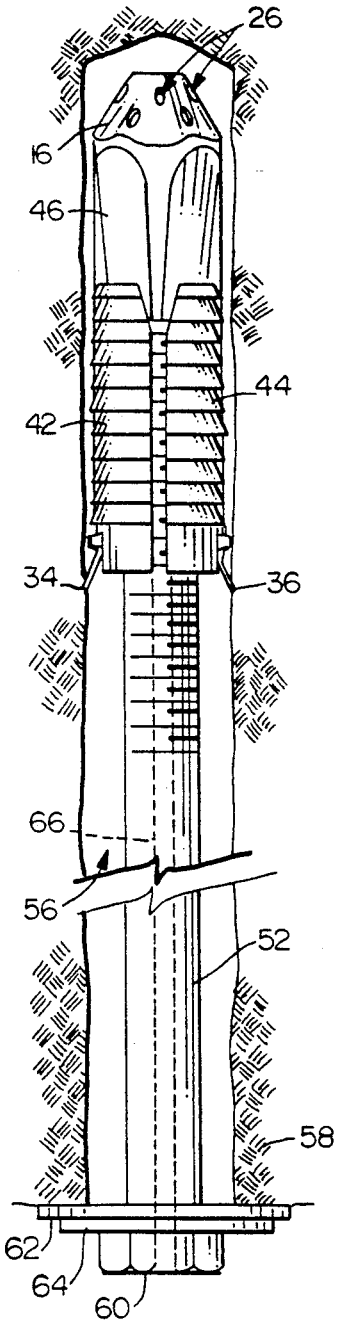
Figure 6:
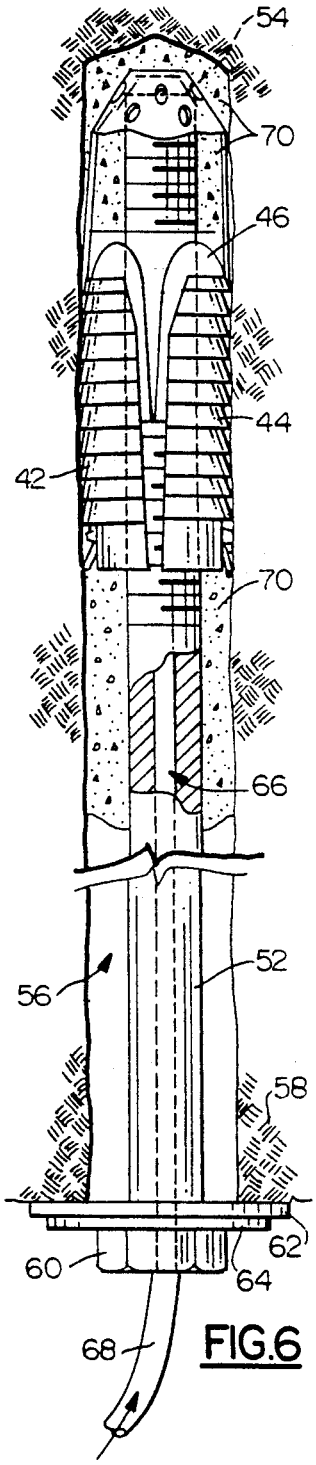

Anchor 40 is mounted on the distal end of bolt 52 which extends through the hollow shell structure and is threaded through a central bore of plug 46. When so mounted, the periphery of terminal end 54 of bolt 52 contacts the concave, inner side of medial portion 16. FIGS. 4–6 illustrate a typical sequence of installation of anchor 40 and bolt 52 in a blind drill hole 56 in rock formation 58. The typical power drilling/bolting machine (not shown) used in many parts of the world to effect such installation includes a magazine holding a supply of bolts with anchors carried thereon in the manner shown in FIG. 3. After hole 56 is drilled by a bit carried on a movable boom of the machine, the boom is indexed to position the distal end of a bolt which has been removed from the magazine in alignment with the drill hole.

As seen in FIG. 4, although the axis of bolt 52 may be slightly misaligned with the axis of hole 56, as is often the case, the tapered, convex, outer surface of dome-shaped medial portion 16 provides a lead-in to ensure that the bolt enters the hole. Terminal end 54 of bolt 52 provides reinforcement and rigidity for bail 38 which often hits the jagged and irregular surface of rock formation 58 during the installation process.

The proximal end of bolt 52 includes integral head 60, or other means for engagement by a power wrench of the drilling/bolting machine. Bolt 52 passes through a central opening in conventional bearing plate 62, which is carried on bolt head 60 with hardened washer 64 therebetween. When bolt 52 is fully inserted, as shown in FIG. 5, plate 62 is seated against the surface of rock formation 58 surrounding the open end of drill hole 56. The wrench is then actuated to rotate bolt 52, causing plug 46 to travel axially down the bolt and urge shell halves 42 and 44 radially outwardly into tightly gripping engagement with the wall of drill hole 56, as shown in FIG. 6. Terminal ends 34 and 36 of outwardly flared portions 30 and 32 frictionally engage the drill hole wall to inhibit rotation of the shell halves as bolt 52 is rotated, as disclosed in application Ser. No. 883,115.

In the illustrated embodiment, axial bore 66 extends through bolt 52. After anchor 40 has been installed and bolt 52 appropriately tensioned, the power wrench is removed from engagement with bolt head 60 and the drilling/bolting machine is prepared for installation of another bolt. In some roof support systems it is desirable to provide a hardenable grout about the mechanical anchor. In such installations, tube 68 is suitably engaged with bolt head 60 to provide communication for a source of slurry or grouting mix (not shown) in a flowable state with bore 66 of bolt 52. The grouting mix is pumped through tube 68 and axial bore 66 to exit from terminal end 54 of bolt 52.

Since terminal end 54 may be rather tightly engaged about its periphery with the inner, concave surface of bail medial portion 16, it may be difficult for the grouting mix to flow directly outwardly and downwardly around the bolt. The presence of openings 24 and 26 permit grouting mix 70 to flow upwardly, into the space above bail medial portion 16, and back downwardly, into the space between the bolt and shell halves, and the space between the bolt and drill hole wall below the mechanical anchor, as shown in FIG. 6. Since the outer diameter of peripheral edge 22 of medial portion 16 is closely approximate to the diameter of drill hole 56, the scalloped configuration of the edge also facilitates the downward flow of grouting mix, which subsequently forms a hardened mass about the bolt and anchor.

From the foregoing, it is apparent that the bail configuration and the anchor assembly incorporating the bail facilitate installation of a mine roof bolt in a drill hole by providing a tapered lead-in at the inserted end of the anchor. The bail may also include openings and/or an irregular peripheral outline to permit flow through and/or around the bail of a grouting mix inserted through an axial bore of the anchored bolt.

What is claimed is:

1. In a mine roof expansion anchor having a hollow, radially expansible shell structure with open, upper and lower ends, and a camming plug with a central, internally threaded bore for threaded engagement with a bolt of predetermined diameter and an external surface tapering inwardly from a larger to a smaller diameter end, a bail member for maintaining said shell and plug in mutually assembled relation with said smaller diameter end of said plug inserted in said open upper end of said shell, said bail member comprising:

a) a medial portion of substantially conical configuration, with convex and concave outer and inner sides, respectively, arranged about a central axis; and b) at least two legs extending integrally from opposite sides of said medial portion to terminal ends, said legs being fixedly attached to said shell structure and said medial portion extending over said larger diameter end of said plug with said convex side facing away from said plug and said central axis coaxial with said threaded bore to provide a tapered lead-in for insertion into a drill hole said medial portion being substantially rigid and having a central portion positioned to provide means for blocking advance of said bolt.

2. The invention according to claim 1 wherein said medial portion includes at least one through opening.

3. The invention according to claim 2 wherein said medial portion includes a plurality of through openings.

4. The invention according to claim 1 wherein said medial portion has a peripheral edge of non-circular outline.

5. The invention according to claim 1 wherein said legs are fixedly attached to said shell structure adjacent said lower end thereof.

6. The invention according to claim 1 wherein said medial portion includes a substantially planar portion surrounding and normal to said central axis.

7. The invention according to claim 6 wherein said medial portion includes a through opening positioned in said planar portion.

8. A bail member which holds shell and plug portions of an expansion anchor in mutually assembled relation and facilitates insertion of the anchor, while carried on one end of an elongated bolt of predetermined diameter, into the open end of a blind drill hole, said bail member comprising:

a) a substantially conical medial portion having a central axis and a peripheral edge, said medial portion tapering inwardly from said peripheral edge toward said central axis in a first direction and having a substantially rigid portion surrounding said central axis and means for preventing passage therethrough of a bolt of said predetermined diameter; and b) at least two elongated legs extending integrally from said peripheral edge, substantially parallel to said central axis in a direction opposite said first direction.

9. The bail member of claim 8 wherein said medial portion tapers at an angle of about 55° with respect to said central axis.

10. The bail member of claim 8 wherein said medial portion includes at least one through opening.

11. The bail member of claim 10 wherein said medial portion includes a substantially planar portion surrounding and normal to said opening.

12. The bail member of claim 8 wherein said medial portion includes a plurality of through openings.

13. The bail member of claim 12 wherein said peripheral edge is of non-circular configuration.

14. The bail member of claim 12 wherein one of said plurality of openings is substantially concentric with said central axis.

15. The bail member of claim 14 wherein additional ones of said plurality of openings are substantially symmetrically arranged about said one opening.

16. A mine roof expansion anchor for use with a threaded bolt of predetermined diameter, said anchor comprising:

a) a radially expansible shell having upper and lower ends and substantially symmetrically arranged about a central axis;

b) a camming plug having an internally threaded, through bore of said predetermined diameter and an external surface tapering inwardly from larger to smaller diameter ends, said plug being positioned with said smaller diameter end extending into said upper end of said shell and said bore substantially coaxial with said shell central axis;

c) a bail member having a medial portion of substantially conical configuration, said medial portion tapering inwardly from a peripheral edge in a first direction, and a plurality of elongated legs extending integrally from said peripheral edge to terminal ends in a direction opposite to said first direction; and d) means fixedly attaching said bail legs to said shell with said legs extending substantially parallel to said central axis, and said medial portion extending over said larger diameter end of said plug and positioned substantially coaxially with said central axis, said medial portion including a substantially rigid central portion surrounding said central axis, said central portion including means for preventing advance of said bolt past said central portion.

17. The mine roof anchor of claim 16 wherein the number of said legs is two, and said legs extend from diametrically opposite sides of said peripheral edge.

18. The mine roof anchor of claim 17 wherein said legs are attached to said shell at positions adjacent said lower end of said shell.

19. The mine roof anchor of claim 18 wherein said shell comprises a pair of physically separate shell halves.

20. The mine roof anchor of claim 19 wherein said legs extend outwardly and downwardly from said positions of attachment to said terminal ends.

21. The mine roof anchor of claim 19 wherein said medial portion includes a plurality of through openings.

22. The mine roof anchor of claim 21 wherein said peripheral edge is of non-circular configuration.

23. A mine roof bolt anchoring system for installation in a blind drill hole of predetermined diameter and depth in a rock formation, said system comprising:

a) an elongated bolt having threads extending from one end, wrench engagement means at the other end; and b) a mechanical expansion anchor having:

i) a radially expansible shell having upper and lower ends and a central axis;

ii) a camming plug having an internally threaded bore through which one end of said bolt threadedly extends, and an external surface tapering inwardly from larger to smaller diameter ends, said smaller diameter end extending into said upper end of said shell with said bore being substantially coaxial with said shell central axis; and iii) a bail member having a medial portion of substantially conical configuration positioned over, and tapering inwardly in a direction away from said larger diameter end of said plug, and a plurality of elongated legs extending integrally from said medial portion and fixedly attached to said shell, said medial portion having a substantially rigid central portion surrounding said central axis wherein said central portion includes means for preventing advance of said one end of said bolt past said central portion; whereby c) said medial portion provides a lead-in for insertion of said bolt with said anchor carried thereon into said drill hole.

24. The mine roof bolt anchoring system of claim 23 wherein said bolt contacts said central portion substantially about the periphery of said one end of said bolt, thereby providing reinforcement for said medial portion of said bail as said anchor is inserted in said drill hole.

25. The mine bolt anchoring system of claim 24 wherein said bolt has a through axial bore for insertion into said drill hole of a flowable grouting mix.

26. The mine bolt anchoring system of claim 25 wherein said medial portion has at least one through opening.

27. The mine bolt anchoring system of claim 25 wherein said medial portion has a peripheral outline of non-circular configuration.

28. The mine bolt anchoring system of claim 25 wherein said medial portion has a plurality of through openings.

29. The mine bolt anchoring system of claim 28 wherein one of said plurality of openings is positioned substantially coaxially with said central axis.

30. The mine bolt anchoring system of claim 29 wherein said medial portion includes a substantially planar portion perpendicular to said central axis and surrounding said one opening.

* * * * *